US010317835B2

(12) United States Patent
Hirose

(10) Patent No.: US 10,317,835 B2
(45) Date of Patent: Jun. 11, 2019

(54) PEELING MEMBER AND PEELING DEVICE

(71) Applicant: NTN CORPORATION, Osaka (JP)

(72) Inventor: Kazuo Hirose, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 16/061,281

(22) PCT Filed: Dec. 9, 2016

(86) PCT No.: PCT/JP2016/086750
§ 371 (c)(1),
(2) Date: Jun. 11, 2018

(87) PCT Pub. No.: WO2017/099223
PCT Pub. Date: Jun. 15, 2017

(65) Prior Publication Data

US 2018/0373192 A1 Dec. 27, 2018

(30) Foreign Application Priority Data

Dec. 11, 2015 (JP) ..... 2015-242179
Dec. 9, 2016 (JP) ..... 2016-239260

(51) Int. Cl.
*G03G 15/20* (2006.01)
*G03G 15/00* (2006.01)
(Continued)

(52) U.S. Cl.
CPC ..... *G03G 15/6532* (2013.01); *G03G 15/02* (2013.01); *G03G 15/06* (2013.01); *G03G 15/16* (2013.01); *G03G 15/2053* (2013.01)

(58) Field of Classification Search
CPC ..... G03G 15/2028; G03G 15/6532
(Continued)

(56) References Cited

U.S. PATENT DOCUMENTS 8,494,423 B2 * 7/2013 Soeda ..... G03G 15/2028 399/323
2011/0182631 A1 7/2011 Soeda

FOREIGN PATENT DOCUMENTS

JP 2002-091222 A 3/2002
JP 2003-029565 A 1/2003
(Continued)

OTHER PUBLICATIONS

International Search Report for PCT/JP2016/086750 dated Jan. 17, 2017.
(Continued)

*Primary Examiner* — William J Royer
(74) *Attorney, Agent, or Firm* — Hedman & Costigan, P.C.; James V. Costigan; Kathleen A. Costigan

(57) ABSTRACT

To provide a peeling member capable of suppressing a waving phenomenon of a peeling sheet, contacting linearly with a roller sufficiently, preventing deformation due to jamming of a paper and showing excellent paper peeling performance, and to provide a peeling device provided with the peeling member. The peeling member includes a peeling sheet 10 that peels a paper from a fixing roller 6 of an electronic photographic device. The peeling sheet 10 is formed of one metal plate, the peeling sheet 10 including a peeling portion 2 that forms the distal end portion, and a support portion 3 that is thicker than the peeling portion 2. The peeling portion 2 is arranged at one long side of the metal plate such that a paper passing surface 2*b* of the peeling portion 2 is formed as a flat surface continued to a surface of the support portion 3.

6 Claims, 8 Drawing Sheets

(51) Int. Cl.

| | |
|---|---|
| ***G03G 15/16*** | (2006.01) |
| ***G03G 15/06*** | (2006.01) |
| ***G03G 15/02*** | (2006.01) |

(58) Field of Classification Search
USPC ..... 399/323, 398, 399
See application file for complete search history.

(56) References Cited

FOREIGN PATENT DOCUMENTS

| | | | |
|---|---|---|---|
| JP | 2003-066755 | A | 3/2003 |
| JP | 2005-234131 | A | 9/2005 |
| JP | 2005-242187 | A | 9/2005 |
| JP | 2006-171551 | A | 6/2006 |
| JP | 2007-034017 | A | 2/2007 |
| JP | 2011-154081 | A | 8/2011 |
| JP | 2014-048440 | A | 3/2014 |

OTHER PUBLICATIONS

International Preliminary Report on Patentability dated Jun. 12, 2018.
English Abstract for JP 2002-091222 A dated Mar. 27, 2002.
English Abstract for JP 2006-171551 A dated Jun. 29, 2006.
English Abstract for JP 2005-242187 A dated Sep. 8, 2005.
English Abstract for JP 2011-154081 A dated Aug. 11, 2011.
English Abstract for JP 2014-048440 A dated Mar. 17, 2014.
English Abstract for JP 2007-034017 A dated Feb. 8, 2007.
English Abstract for JP 2005-234131 A dated Sep. 2, 2005.
English Abstract for JP 2003-066755 A dated Mar. 5, 2003.
English Abstract for JP 2003-029565 A dated Jan. 31, 2003.

* cited by examiner

PEELING MEMBER AND PEELING DEVICE

TECHNICAL FIELD

The present invention relates to a peeling member that peels a paper from various types of rollers arranged in an electronic photographic device such as a copying machine and a laser printer, in particular relates to a peeling member for a fixing member such as a fixing roller. Further, the present invention relates to a peeling device provided with the peeling member.

BACKGROUND ART

In an electronic photographic device such as a copying machine and a laser printer, various types of rollers that develop an electrostatic latent image, which is formed on a photoreceptor drum, on a paper by using a developing agent such as toner and then fixes the developed image is arranged. In a developing portion, the photoreceptor drum and an oil coating roller except in a dry type electronic photographic are arranged, and in a fixing portion, a fixing roller and a pressing roller are arranged. Conventionally, in a photoreceptor drum, a fixing roller or a pressing roller, a separation claw is arranged in order to facilitate smooth operation of a roller by preventing a paper from winding on the roller. The separation claw is formed to prevent a paper from winding on the roller by sliding a distal end of the separation claw on an outer peripheral surface so as to scoop an edge of the paper. A width of a contact portion of the separation claw with the roller is approximately 1 mm to 10 mm. The separation claws are arranged at four to sixteen portions in each roller. Since the separation claw is contacted with the roller in part, the roller is partially worn and an excellent quality image cannot be obtained. Further, since the separation claw is also contacted with a paper in part, the developing agent transferred to the paper is scraped easily, and therefore the paper might be get dirt due to the scraped developing agent stuck to the separation claw.

Against this problem, as a peeling member capable of linearly contacting with the roller of the electronic photographic device, a peeling member formed by joining a peeling sheet, which peels a paper from a roller, formed of a metal thin plate to a support member formed of a metal material by means of laser spot welding is disclosed (see Patent Document 1). In the peeling member, the peeling sheet can be linearly contacted with the roller, and thereby local wear of the roller can be prevented.

Further, as a separation plate (peeling member) of the electronic photographic device, a separation plate in which a distal end of the separation plate is rolled and an abutting portion formed of the same metal plate of the separation plate is arranged in order to form a gap against an opposite roller at both end portions of the distal end portion, is disclosed (see Patent Document 2).

PRIOR ART DOCUMENTS

Patent Documents

Patent Document 1: JP 2002-091222 A
Patent Document 2: JP 2006-171551 A

SUMMARY OF THE INVENTION

Problems to be Solved by the Invention

The peeling member disclosed in Patent Document 1 has a structure that ensures precision of the distal end portion of the peeling sheet by supporting the peeling sheet formed of a thin plate by the support plate as a metal base plate, and therefore the peeling member has a simple shape. Consequently, the peeling member can be made thin or small. Further, since the support member and the peeling sheet are joined by means of laser spot welding, the joining force is thermally stabled compared to a configuration in which the peeling sheet and the support member are joined by an adhesive. Thus, although the peeling sheet formed of a thin plate is used, a waving phenomenon of the peeling sheet can be suppressed. Here, the waving phenomenon denotes a phenomenon in which the peeling sheet and the support member are separated in part and waving is generated on the peeling sheet, so that a paper is not peeled smoothly.

However, in order to weld the peeling sheet to the support member by means of laser spot welding, equipment such as a laser irradiation device or a special jig is necessary, and therefore a producing cost becomes high. Further, it is difficult to ensure sufficient joining strength of a welded portion in some materials of the peeling sheet and the support member, and therefore the waving phenomenon might not be suppressed.

On the other hand, in Patent Document 2, the peeling portion (distal end portion) and the support member are formed of the same metal plate, and therefore the problem relating to the joining is not generated. However, in a case in which a distal end thin part (peeling portion) of the metal plate to be arranged close to the roller is long, when jamming of a thick paper is generated, the distal end thin part may be deformed largely by the thick paper. This occurs similarly in a configuration in which a thin plate is used as the peeling sheet as disclosed in Patent Document 1. Especially, in recent years, a printing speed is made high, and it becomes important to maintain horizontal precision of the distal end portion while preventing the deformation thereof.

An object of the present invention is, in order to solve such a problem, to provide a peeling member capable of suppressing a waving phenomenon of a peeling sheet, contacting linearly with a roller sufficiently, preventing deformation due to jamming of a paper and showing excellent paper peeling performance, and to provide a peeling device provided with the peeling member.

Means for Solving the Problem

A peeling member of the present invention includes a peeling sheet that peels a paper from a roller of an electronic photographic device, and a support member that supports the peeling sheet to be inclined against the roller at a predetermined angle such that a distal end portion of the peeling sheet is arranged close to the roller. The peeling sheet is formed of one metal plate, the peeling sheet including a peeling portion that forms the distal end portion, and a support portion that is thicker than the peeling portion and is fixed to the support member. The peeling portion is arranged at one long side of the metal plate such that a paper passing surface of the peeling portion is formed as a flat surface continued to a surface of the support portion and an opposite paper passing surface of the peeling portion is formed as an inclined surface inclined against the paper passing surface such that a thickness of the peeling portion is increased from a most distal end portion of the peeling portion toward a boundary portion between the peeling portion and the support portion. The inclined surface is arranged at a side of the roller, and a distance D1 between the most distal end portion and the roller and a distance D2 between the boundary portion and the roller fulfill a relation of D1≤D2≤5×D1.

Here, "close to" denotes that the distal end portion of the peeling sheet (one side of the metal plate) of is arranged close to the roller to such an extent that a paper can be prevented from winding around the roller. Examples of the roller of the electronic photographic device include a photoreceptor drum, a fixing roller (including a belt roll), and a pressing roller.

Further, "the distance between the most distal end and the roller" denotes, when a line is formed between the center of the roller and the most distal end portion in a radial direction section of the roller, a length on the line between an intersection of the line and a surface of the roller (a surface position of the roller) and the most distal end portion. Similarly, "the distance between the boundary portion (between the peeling portion and the support portion) and the roller" denotes that, when a line is defined between the center of the roller and the boundary portion in the radial direction section of the roller, a length on the line between an intersection of the line and the surface of the roller (a surface position of the roller) and the boundary portion. Further, the boundary portion between the peeling portion and the support portion denotes a portion of a boundary between the inclined surface of the peeling portion and the opposite paper passing surface of the support portion.

In the peeling portion, the thickness of the distal end portion may be set in a range between 0.05 mm and 0.4 mm, and a width in a paper passing direction of the inclined surface may be set in a range between 1 mm and 10 mm.

In the peeling portion, the inclined surface may be formed as an inclined flat surface, and an inclined angle of the inclined surface against the paper passing surface may be set in a range between 5° and 45°.

The inclined surface may be formed to conform to a closest surface of the roller with respect to the inclined surface.

The peeling sheet may be formed by sticking a non-adhesive resin film to at least the paper passing surface of the peeling portion via a silicon-based adhesive, and the non-adhesive resin film may be formed as a fluororesin film formed of at least one of polytetrafluoroethylene (PTFE) resin, tetrafluoroethylene-perfluoroalkyl vinyl ether copolymer (PFA) resin, tetrafluoroethylene-hexafluoropropylene copolymer (FEP) resin, and tetrafluoroethylene-ethylene copolymer (ETFE) resin.

A peeling device of the present invention includes a roller of an electronic photographic device, and a peeling member. The peeling member includes a peeling sheet that peels a paper from a roller of an electronic photographic device, and a support member that supports the peeling sheet to be inclined against the roller at a certain angle such that a distal end portion of the peeling sheet is arranged close to the roller. The peeling sheet is formed of one metal plate, the peeling sheet including a peeling portion that forms the distal end portion, and a support portion that is thicker than the peeling portion and is fixed to the support member. The peeling portion is arranged at one long side of the metal plate such that a paper passing surface of the peeling portion is formed as a flat surface continued to a surface of the support portion and an opposite paper passing surface of the peeling portion is formed as an inclined surface inclined against the paper passing surface in which a thickness is increased from a most distal end portion of the peeling portion toward a boundary portion with the support portion. The inclined surface is arranged at a side of the roller, and a distance D1 between the most distal end portion and the roller and a distance D2 between the boundary portion and the roller fulfill a relation of D1≤D2≤5×D1. Here, "close to", "the distance between the most distal end portion and the roller", and "the distance between the boundary portion (between the peeling portion and the support portion) and the roller" are similar to those in the peeling member of the present invention described above.

Effect of the Invention

The peeling member of the present invention includes the peeling sheet that peels a paper from a roller of an electronic photographic device, and the support member that supports the peeling sheet to be inclined against the roller at a predetermined angle such that the distal end portion of the peeling sheet is arranged close to the roller; the peeling sheet is formed of one metal plate having a thin peeling portion and a thick support portion; the paper passing surface of the peeling portion is formed as a flat surface continued to the surface of the support portion; and the opposite paper passing surface of the peeling portion is formed as an inclined surface inclined against the paper passing surface. Thus, the peeling member can be inserted easily into the narrowest portion between the rollers or between the roller and a belt, and thereby excellent peeling performance can be obtained. In this configuration, the distance D1 between the most distal end portion and the roller and the distance D2 between the boundary portion of the peeling portion and the support portion and the roller fulfill a relation of D1≤D2≤5×D1. Thus, a thickness of the peeling portion to be the distal end portion of the peeling sheet can be made thick sufficiently in the narrowest portion, and thereby deformation of the distal end portion due to jamming of a thick paper can be prevented. Further, the peeling device of the present invention includes the roller of the electronic photographic device, and the peeling member having the configuration described above. Thus, the peeling device has the effects obtained by the peeling member.

Further, the peeling sheet is formed of one metal plate having the thin peeling portion and the thick support portion, and therefore a special jig or a laser generation device used in laser welding is not necessary. Consequently, the peeling member can be manufactured at a low cost. Further, the peeling member is not affected by heat, and deviation of joining force in a portion in which a plurality of members is joined is less, and therefore a waving phenomenon is not generated. As a result, the distal end portion of the peeling sheet (peeling portion) can be arranged to be contacted with or to be close to the roller stably for a long period of time, and therefore a paper can be smoothly peeled. Further, the problem that a spatter, which is generated in the laser welding and welded on the paper passing surface, that might catch a paper is generated, can be avoided.

Further, in the peeling portion of the peeling sheet, the thickness of the most distal end portion is set in a range between 0.05 mm and 0.4 mm, and the width in the paper passing direction of the inclined surface is set in a range between 1 mm and 10 mm. Consequently, the generation of the jamming can be prevented while ensuring peeling force.

Further, the inclined surface is formed to conform to the closest surface of the roller with respect to the inclined surface while fulfilling the relation between D1 and D2 described above. Consequently, the thickness of the distal end portion can be made thick as much as possible, and the deformation due to the jamming can be further prevented.

Further, the peeling sheet is formed by sticking the non-adhesive resin film to at least the paper passing surface of the peeling portion via the silicon-based adhesive. Consequently, the non-adhesive resin film can be firmly stuck to the peeling portion and a sticking effect of the non-adhesive resin film can be maintained at a fixing temperature, and therefore excellent high heat resistance can be obtained. Further, a cushioning effect of the adhesive can be expected. Further, the non-adhesive resin film is formed as a fluororesin film formed of at least one of PTFE resin, PFA resin, FEP resin, and ETFE resin. Consequently, a toner adhering prevention effect becomes extremely high, and therefore excellent low friction performance with a paper can be obtained.

MODE FOR CARRYING OUT THE INVENTION

Figure 1:
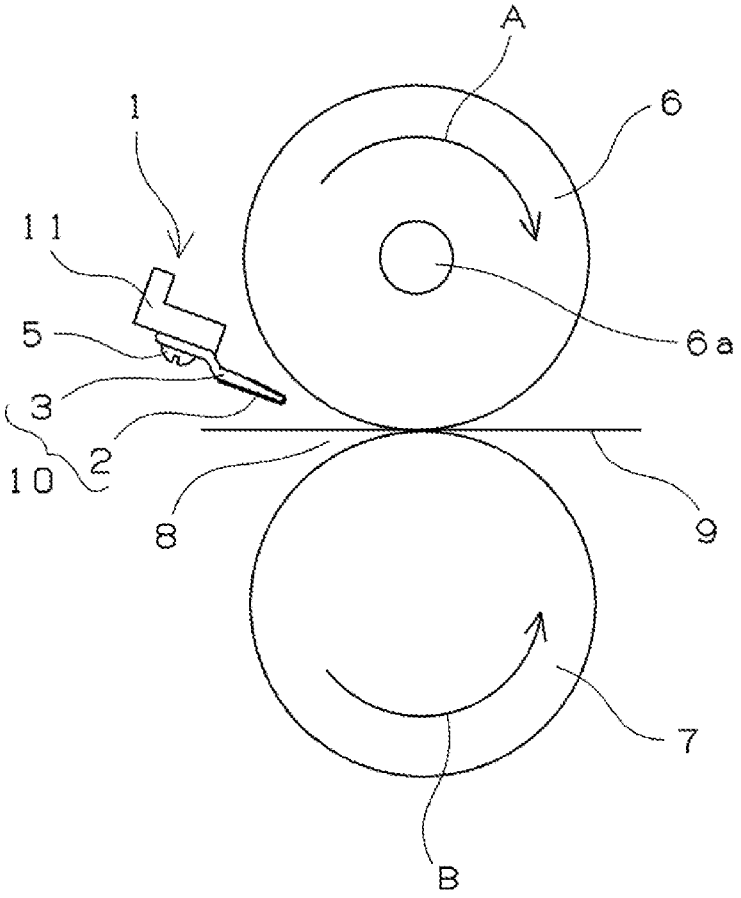
FIG. 1 is a schematic view of a fixing device using a peeling member of the present invention.

A fixing device using a peeling member of the present invention is described with reference to FIG. 1. FIG. 1 is a schematic view of a heat roller type fixing device using the peeling member. The fixing device is provided with a fixing roller 6 in which a heater 6*a* is installed, the fixing roller 6 rotated in a direction of an arrow A, a pressing roller 7 rotated in a direction of an arrow B while contacting with the fixing roller 6, and a peeling member 1 arranged close to a nip portion 8 formed when the fixing roller 6 and the pressing roller 7 are contacted with each other. A toner image formed on a paper 9 is fixed at the nip portion 8 and turned into a fixed image. The peeling member 1 is provided with a peeling sheet 10 for peeling a paper from the fixing roller 6, and a support member 11 that supports the peeling sheet 10. A support portion 3 of the peeling sheet 10 is fixed by a bolt 5 to the support member 11. The support member 11 is formed to support the peeling sheet 10 to be inclined against the fixing roller 6 at a predetermined angle such that a peeling portion 2 as a distal end portion of the peeling sheet 10 is arranged close to the fixing roller 6. With this, the paper 9 passed through the nip portion 8 can be peeled from the fixing roller 6.

The peeling member 1 corresponds to the peeling member of the present invention. Further, a peeling device of the present invention is formed as a part of the fixing device. The peeling device of the present invention is provided with the peeling member 1 and a roller (the fixing roller 6 in FIG. 1) of an electronic photographic device to which the peeling member 1 is arranged to be close.

Figure 2:
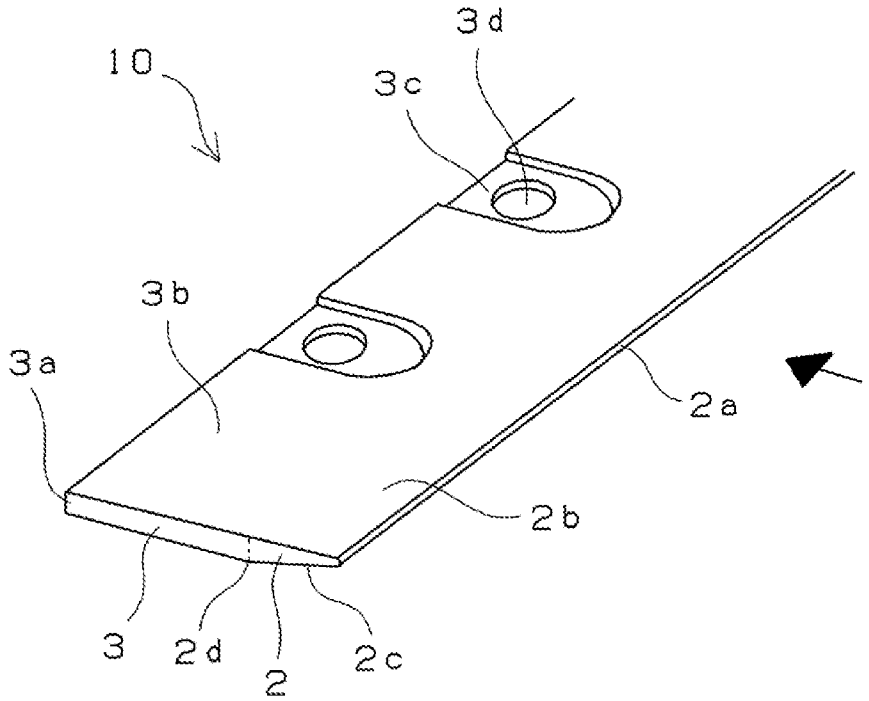
FIG. 2 is a perspective view illustrating a part of one example of a peeling sheet of the present invention.
Figure 3:
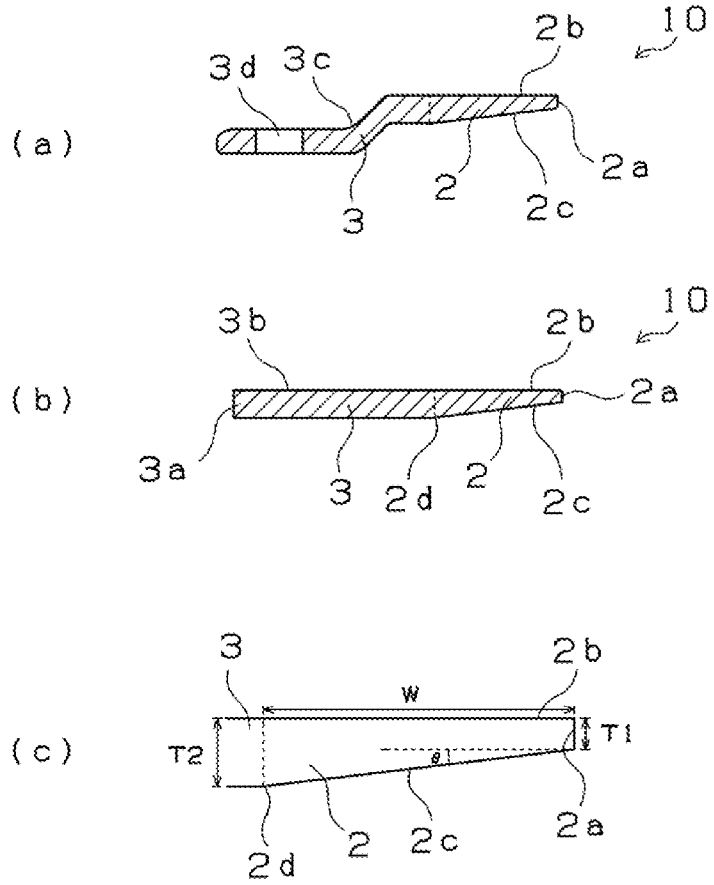
FIGS. 3(*a*) to 3(*c*) are cross-sectional views (end surface views) of the peeling member shown in FIG. 2.

One example of the peeling sheet forming the peeling member of the present invention is described with reference to FIG. 2 and FIGS. 3(*a*) to 3(*c*). FIG. 2 is a perspective view of a part of the peeling member. FIG. 3(*a*) is a cross-sectional view (end surface view) illustrating a part of the peeling sheet having a recess portion for bolt fixing. FIG. 3(*b*) is a cross-sectional view (end surface view) illustrating a part of the peeling member without the recess portion. FIG. 3(*c*) is a partially enlarged view of FIG. 3(*b*). As shown in FIG. 2 and FIGS. 3(*a*) to 3(*c*), the peeling sheet 10 is formed of one metal plate (substantially elongated flat plate). The peeling sheet 10 is provided with a peeling portion 2 forming a distal end portion, and a support portion 3 having a wall thickness thicker than that of the peeling portion 2. The peeling sheet 10 is formed in a substantially rectangular shape in a plane view. A black arrow in FIG. 2 indicates a paper passing direction, and a longitudinal direction of the peeling sheet 10 is orthogonal to the paper passing direction. A most distal end portion 2*a* of the peeling portion 2 is arranged at an upstream side in the paper passing direction and formed as an edge portion at one long side of the peeling portion 2. In the peeling portion 2, a paper passing surface 2*b* is formed as a flat surface without a recess and projection portion. A paper passing surface 3*b* of the support portion 3 is formed as a flat surface continued to the paper passing surface 2*b* of the peeling portion 2. The paper passing surface 2*b* and the paper passing surface 3*b* form a paper passing surface of the peeling sheet 10. An opposite paper passing surface of the peeling portion 2 is formed as an inclined surface 2*c*. The inclined surface 2*c* is formed as an inclined flat surface inclined against the paper passing surface 2*b* such that a thickness of the peeling portion 2 is increased at a certain rate from the most distal end portion 2*a* of the peeling portion 2 toward a boundary portion 2*d* between the peeling potion 2 and the support portion 3. The peeling sheet 10 is arranged such that the inclined surface 2*c* of the peeling portion 2 is directed to various types of rollers such as the fixing roller as a target and the most distal end portion 2*a* is arranged close to the roller so that the peeling sheet 10 scoops an edge of a paper peeled from the roller (see FIG. 1).

The peeling portion 2 is formed as a linear tapered portion by cutting a metal plate obliquely at one long side by means of pressing, rolling, or a cutter such that a thickness of the peeling portion 2 in the paper passing direction (short side direction) is continuously changed at a certain rate. A thickness of the peeling portion 2 in the longitudinal direction is constant. In a case in which the metal plate is obliquely rolled by means of pressing, the one long side is cut into a predetermined size by means of pressing. At this time, it is preferable that both short sides are cut into a predetermined size. With this, deformation or the like when in use can be prevented, and excellent precision of the most distal end portion 2*a* of the peeling portion 2 can be obtained.

A thickness of the support portion 3 is constant corresponding to a thickness of a metal plate before processed. In the support portion 3, recess portions 3*c* corresponding to a fixing portion to the support member 11 are arranged along the longitudinal direction with a certain interval, at an end portion 3*a* (an end portion at a downstream side in the paper passing direction) opposite to the peeling portion 2. The recess portions 3*c* are formed in a region other than the peeling portion 2 formed as a tapered portion. The number of the recess portions 3*c* and the interval thereof are appropriately determined. The recess portions 3*c* are formed by means of drawing processing or the like. Each of the recess portions 3*c* is formed to be opened toward an outside of the end portion 3*a*. It is preferable that a deformed portion in the longitudinal direction of the recess portions 3*c* due to the drawing processing is cut into a predetermined size, and thereby precision of the support portion 3 is not deteriorated in the drawing processing. Each of the recess portions 3*c* has a bolt hole 3*d* for bolt fixing. It is preferable to set a depth of each of the recess portions 3*c* to be deeper than a height of a head of the bolt (see FIGS. 5(*a*) to 5(*c*) described below).

As a material of the metal plate that forms the peeling sheet 10, iron, aluminum, copper, stainless steel or the like maybe used. Especially, stainless steel is preferable because stainless steel is not rusted and processing of stainless steel is easy and stainless steel is low in cost.

An outline of a size of each part of the peeling sheet is described with reference to FIG. 3(*c*). A thickness T2 (a thickness of a metal plate) of the support portion 3 is preferably set in a range between 1 mm and 5 mm, more preferably in a range between 1.3 mm and 2 mm. A width W of the peeling portion 2 in the paper passing direction is preferably set in a range between 1 mm and 10 mm, more preferably in a range between 1 mm and 7 mm, much more preferably in a range between 3 mm and 5 mm. Further, as described above, the peeling portion 2 in the FIG. 3(*c*) is formed as a linear tapered portion, and the inclined surface 2*c* is formed as an inclined flat surface. An inclined angle θ of the inclined surface 2*c* against the paper passing surface 2*b* of the peeling portion 2 is preferably set in a range between 5° and 45°, more preferably in a range between 10° and 30°.

A thickness T1 of the most distal end portion 2*a* of the peeling portion 2 is preferably set in a range between 0.05 mm and 0.4 mm, more preferably in a range between 0.1 mm and 0.4 mm. In a case in which the thickness T1 of the most distal end portion 2*a* is less than 0.05 mm, the peeling force cannot be sufficiently ensured, and the non-adhesive resin film stuck to the peeling portion 2 might be broken. On the other hand, in a case in which the thickness T1 of the most distal end portion 2*a* is more than 0.4 mm, a paper to be peeled is abutted to the most distal end portion 2*a* of the peeling portion, and therefore jamming might be generated.

The peeling portion 2 has a width substantially the same as a length of the roller in an axial direction. Here, the width substantially the same as the length of the roller in the axial direction denotes a width more than substantially half of the length of the roller in the axial direction and the same as or slightly longer than the length of the roller in the axial direction.

In order to improve paper peeling performance, it is preferable to apply a lubrication coating film or to stick a non-adhesive resin film to at least the paper passing surface of the most distal end portion 2*a* of the peeling portion 2. In particular, it is more preferable to stick the non-adhesive resin film because excellent peeling performance and excellent high temperature resistance can be obtained.

Figure 4:
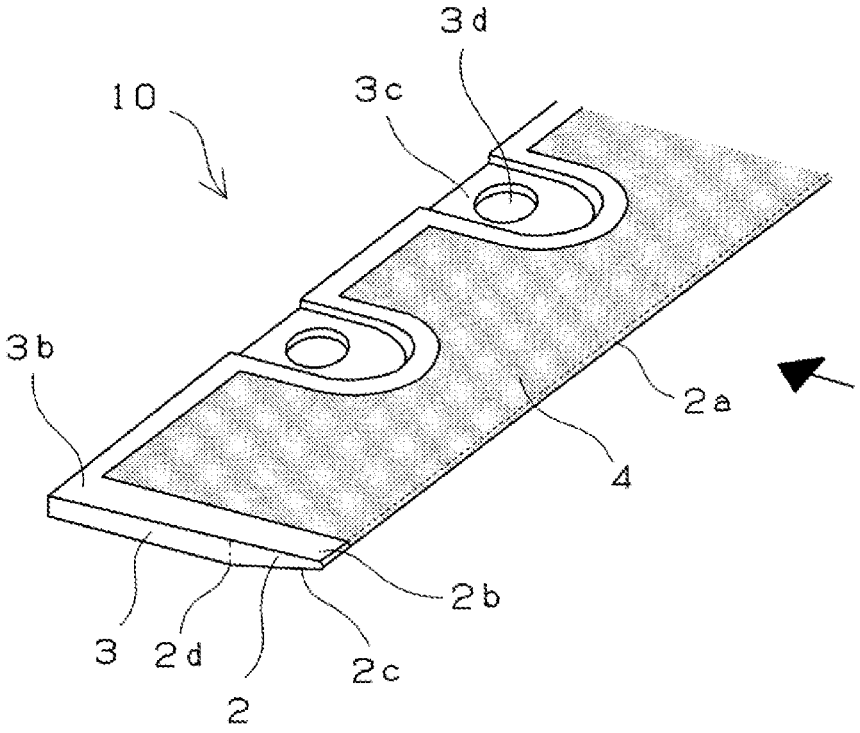
FIG. 4 is a perspective view illustrating a part of an example of the peeling member shown in FIG. 2 with a non-adhesive resin film stuck thereto.
Figure 5:
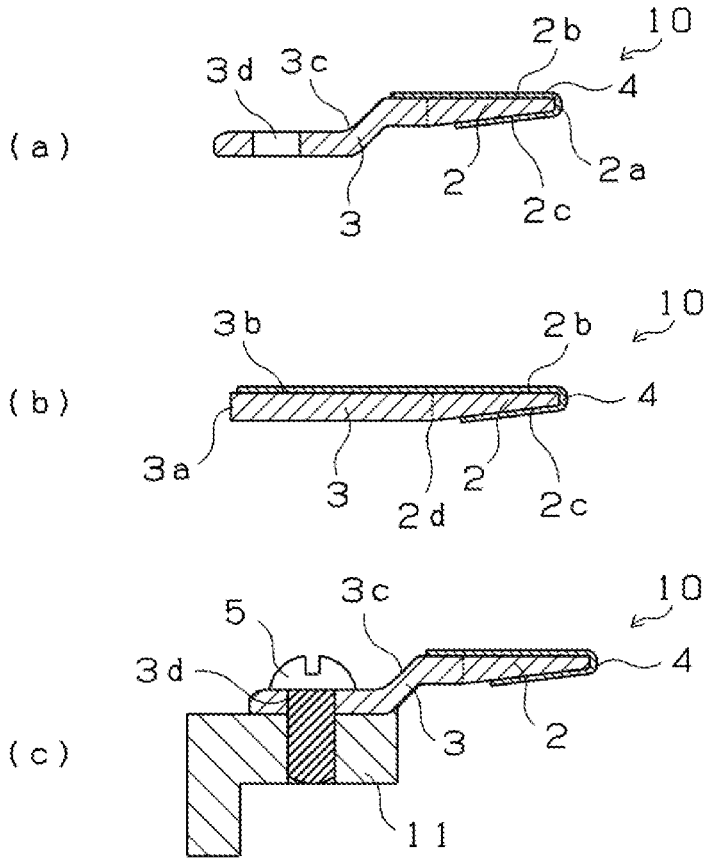
FIGS. 5(*a*) to 5(*c*) are cross-sectional views (end surface views) of the peeling member shown in FIG. 4.

FIG. 4 and FIGS. 5(*a*) to 5(*c*) show an example in which the non-adhesive resin film is stuck to the peeling sheet shown in FIG. 2. FIG. 4 is a perspective view illustrating a part of the peeling sheet with the non-adhesive resin film stuck thereto. FIG. 5(*a*) is a cross-sectional view (end surface view) illustrating a part of the peeling sheet including the recess portion for bolt fixing. FIG. 5(*b*) is a cross-sectional view (end surface view) illustrating a part of the peeling sheet without the recess portion. FIG. 5(*c*) is a cross-sectional view (end surface view) including the support member. In the example shown in FIG. 4 and FIGS. 5(*a*) to 5(*c*), a non-adhesive resin film 4 is stuck from the paper passing surface 2*b* to the inclined surface 2*c* so as to cover the most distal end portion 2*a* of the peeling portion 2. Further, the non-adhesive resin film 4 is stuck from the paper passing surface 2*b* of the peeling portion 2 to the paper passing surface 3*b* of the support portion 3.

The non-adhesive resin film has non-adhesiveness to such an extent that can prevent the developing agent from adhering. As the non-adhesive resin film, for example, polyethylene resin film, polypropylene resin film, or a film formed of known resin such as PTFE resin, PFA resin, FEP resin, ETFE resin, polychlorotrifluoroethylene resin, chlorotrifluoroethylene-ethylene copolymer resin, polyvinylidene fluoride resin, and polyvinyl fluoride resin. In particular, the fluororesin film formed of PTFE resin, PFA resin, FEP resin or ETFE resin has excellent non-adhesiveness with respect to color toner (toner using polyester-based binder resin or the like) and sufficient heat resistance. Further, the non-adhesive resin film may be formed of non-adhesive resin to which carbon fine powder such as Ketjen black or acetylene black is compounded as long as the non-adhesiveness with respect to the toner can be ensured, so that deterioration of the paper peeling performance due to static electricity can be prevented.

A thickness of the non-adhesive resin film formed of fluororesin or the like is preferably set in a range between 10 μm and 200 μm, more preferably in a range between 40 μm and 80 μm. In a case in which the thickness is less than 10 μm, the non-adhesive resin film might be broken due to friction with the developing agent, or the distal end portion of the peeling sheet might be exposed due to slight wear. Further, a crinkle is easily generated in a sticking process to the peeling sheet, and therefore handling of the non-adhesive resin film becomes difficult. In a case in which the thickness is more than 200 μm, the paper peeling performance is deteriorated.

It is preferable to stick the non-adhesive resin film to the peeling sheet by arranging an adhesive, in particular a silicon-based adhesive on a surface to be stuck. For example, the non-adhesive resin film in which the silicon-based adhesive is applied to the surface to be stuck to the peeling sheet is used. Example of the silicon-based adhesive includes an adhesive obtained by condensing copolymer formed by an $SiO_2$ unit and a $(CH_3)_3SiO$ unit, and diorganopolysiloxane raw rubber. By arranging the silicon-based adhesive therebetween, the non-adhesive resin film can be stuck to the peeling sheet firmly and a sticking effect of the non-adhesive resin film can be maintained at a fixing temperature, and further a cushioning effect of the adhesive can be expected. Besides this, for example, it is preferable to apply surface treatment such as corona discharge treatment, sputter etching treatment, plasma etching treatment, TOS treatment by metallic sodium, and ultraviolet irradiation treatment to the surface to be stuck to the peeling sheet.

A thickness of a silicon-based adhesive layer may be set in a range between 5 μm and 50 μm. In a case in which the thickness is less than 5 μm, the sticking effect cannot be obtained sufficiently. Further, in a case in which the thickness is more than 50 μm, the paper peeling performance might be deteriorated because the thickness of the peeling sheet becomes relatively thick. Further, the non-adhesive resin film may be stuck to the peeling portion without the adhesive. For example, a method in which the non-adhesive resin film is press-bonded under heating after the surface of the peeling sheet to be stuck (the paper passing surfaces 2*b*, 3*b*) are roughened by subjecting to plasma etching treatment or the like, may be adopted.

A fixing structure between the peeling sheet and the support member is described with reference to FIG. 5(*c*). As shown in FIG. 5(*c*), the support portion 3 of the peeling sheet 10 is fixed to the support member 11 by the bolt 5. The bolt 5 is fixed to the support member 11 through the bolt hole 3*d* of the recess portion 3*c* of the support portion 3. The bolt is fastened such that the head of the bolt 5 is not protruded from the recess portion 3*c*, so that the deterioration of the paper peeling performance can be prevented. In a case in which the peeling sheet is merely formed of a thin plate or the like, it is necessary to support a portion close to the distal end portion by using the support member so as to ensure precision of the distal end portion to be arranged close to the roller. Against this, the peeling sheet 10 of the present invention is formed by integrating the peeling portion 2 and the support portion 3, and therefore by only supporting the support portion 3 by using the support member 11, the peeling portion 2 is also supported stably. Thus, horizontal precision of the most distal end portion 2*a* of the peeling portion 2, which affects the peeling performance largely, can be maintained to be high, and therefore excellent paper peeling performance can be obtained.

In the peeling member of the present invention, the peeling sheet described above is supported by the support member at a predetermined angle against the roller, and a distance D1 between the most distal end portion of the peeling portion of the peeling sheet and the roller and a distance D2 between the boundary portion between the peeling portion and the support portion and the roller fulfill a predetermined relation (D1≤D2≤5×D1). The relation is described with reference to FIG. 6.

Figure 6:
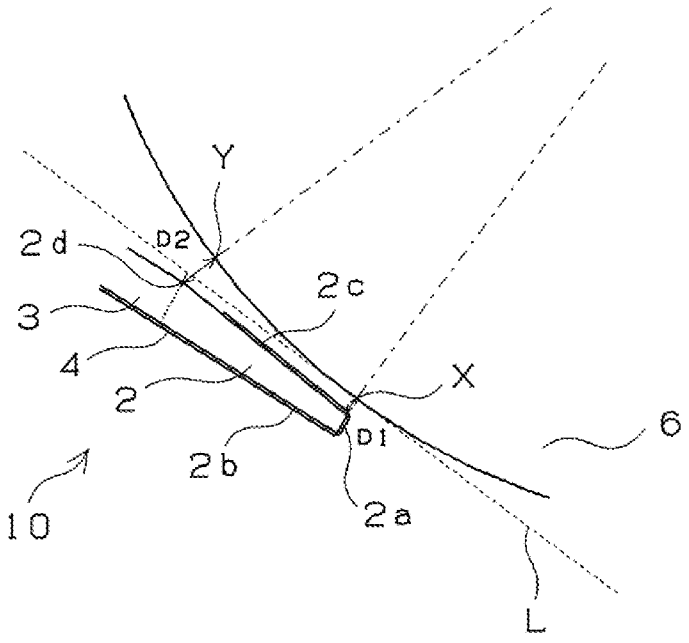
FIG. 6 is an enlarged view (inclined flat surface) around the peeling sheet in the fixing device.

FIG. 6 is an enlarged view around the peeling sheet in the fixing device. As shown in FIG. 6, the peeling sheet 10 is supported such that the peeling sheet 10 is inclined against the fixing roller at a predetermined angle and the peeling portion 2, which is a distal end portion of the peeling sheet 10, is arranged close to the fixing roller 6. The distance D1 between the most distal end portion 2*a* of the peeling portion 2 and the fixing roller 6 and the distance D2 between the boundary portion 2*d* between the peeling portion 2 and the support portion 3 and the fixing roller 6 fulfill the relation of D1≤D2≤5×D1. Here, when a line is defined between the center of the roller and the most distal end portion 2*a* in a radial direction section of the fixing roller 6, the distance D1 is represented by a length on the line between an intersection X of the line and a surface of the roller and the most distal end portion 2*a*. Further, when a line is defined between the center of the roller and the boundary portion 2*d* in the radial direction section of the fixing roller 6, the distance D2 is represented by a length on the line between an intersection Y of the line and the surface of the roller and the boundary portion 2*d*. Further, in a case in which the non-adhesive resin film 4 is stuck to the peeling portion 2, a distance between the peeling portion including the non-adhesive resin film 4 and the roller is set to fulfill the relation described above.

In the peeling member, each of the shape, the size, and support angle of the peeling sheet is adjusted to fulfill such a relation. By fulfilling the relation, the thickness of the peeling portion 2 formed as the distal end portion of the peeling sheet can be made thick sufficiently, and therefore even if jamming of a thick paper is generated, the deformation of the distal end portion can be prevented. It is more preferable that the distance D1 and the distance D2 fulfil D1≤D2≤3×D1 in order to ensure the thickness of the peeling portion 2 as much as possible.

Here, the peeling portion 2 is set not to contact with the fixing roller 6 in a region between the most distal end portion 2*a* and the boundary portion 2*d*. For example, in the cross-section shown in FIG. 6, the contact described above can be avoided by setting the inclined surface 2*c* of the peeling portion 2 such that the inclined surface 2*c* is substantially parallel to a tangent line L at the intersection X, which is the closest portion of the fixing roller 6 with respect to the peeling sheet 10, or the inclined surface 2*c* is inclined to a side in which D2>D1 is fulfilled.

Figure 7:
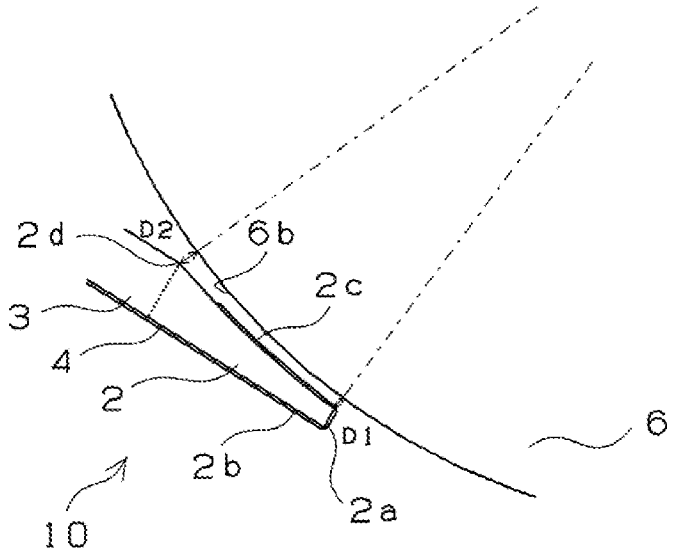
FIG. 7 is an enlarged view (inclined curve surface) around the peeling sheet in the fixing device.

Another example of the peeling sheet that forms the peeling member of the present invention is described with reference to FIG. 7. FIG. 7 is a view corresponding to FIG. 6. FIG. 7 is an enlarged view around the peeling sheet in the fixing device. As shown in FIG. 7, a peeling sheet 10 in this example fulfills the relation between D1 and D2 described above and an inclined surface 2*c* of a peeling portion 2 is formed to conform to a closest surface 6*b* of a fixing roller 6 with respect to the inclined surface (inclined curve surface) . The inclined surface 2*c* and the closest surface 6*b* are substantially parallel to each other. A gap between the inclined surface 2*c* and the closest surface 6*b* is substantially constant in a region of the inclined surface 2*c*. By adopting such a shape, a thickness of the peeling portion 2 formed as a distal end portion can be made thick as much as possible, and the deformation of the distal end portion due to jamming can be further prevented.

EXAMPLE

Example 1

Figure 8:
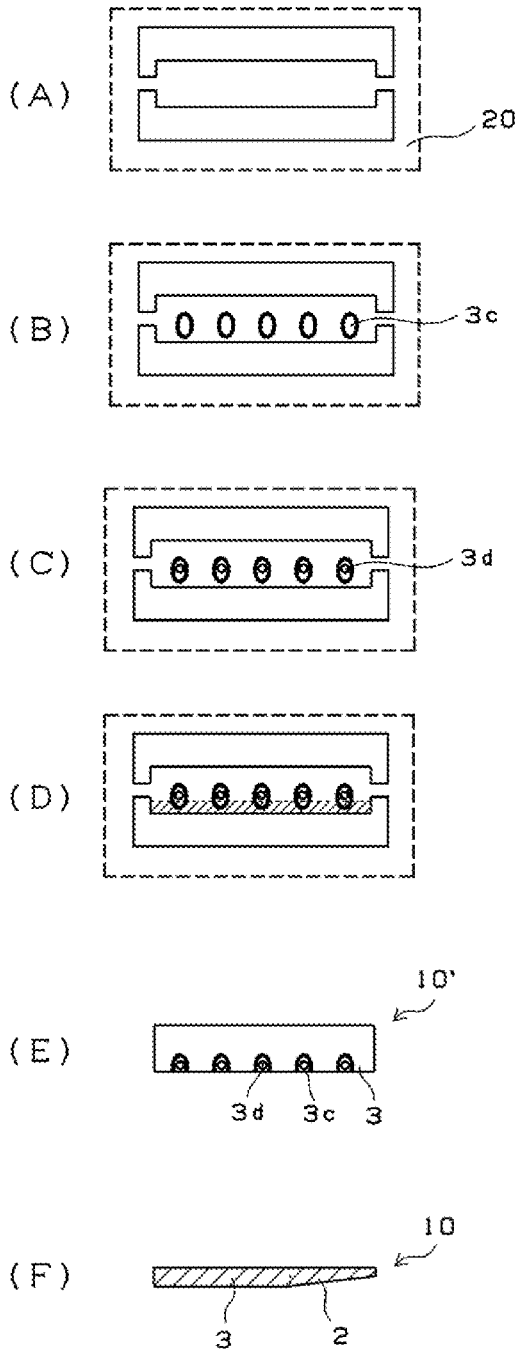
FIG. 8 is a schematic view illustrating a manufacturing process of the peeling member of the present invention.

A peeling member was manufactured by processing a distal end portion into a tapered shape by means of machine processing after processing a stainless (SUS304CSP) coil having a thickness of 1.5 mm into a predetermined size by using a progressive press die. The manufacturing process is described with reference to FIG. 8. FIG. 8 is a schematic view of the manufacturing process. The processes (A) to (F) show a schematic order of the process. At first, a steel plate 20 shown in the process (A) is punched into an external size of the peeling sheet by using a press die. Next, the recess portions 3*c* are formed by means of drawing processing as shown in the process (B). Next, the bolt holes 3*d* for bolt fixing are punched by using a press die as shown in the process (C). And then, the drawn portion is cut into a predetermined size as shown in the process (D). After that, a peeling sheet 10' before forming a tapered portion is punched from the steel plate 20 as shown in the process (E). Finally, the opposite paper passing side opposite to the drawn portion is cut into a tapered shape by means of machine processing and grinded, so that the peeling sheet 10 having the peeling portion 2 formed in a tapered shape and the support portion 3 is obtained as shown in the process (F). The peeling sheet 10 has a thickness of the most distal end portion of 0.2 mm and a width of the peeling portion in the paper passing direction of 5 mm.

Next, a fluororesin film is stuck to the paper passing surface and the inclined surface of the peeling portion 2 and the paper passing surface of the support portion 3. As the fluororesin film, a PTFE film (Bearee FL3090 produced by NTN Engineering Plastics Corporation) having a thickness of 50 μm is prepared and is subjected to etching treatment that immerses a surface of the fluororesin film to be stuck to the peeling member into a metallic sodium ammonia solution. The surface of the fluororesin film subjected to the etching treatment is coated uniformly with a silicon-based adhesive solution (KR101 produced by Shin-Etsu Chemical Co., Ltd.) including dimethyl polysiloxane raw rubber and then heated and dried at a temperature of 120° C. to 200° C. After that, the fluororesin film is cooled to a room temperature by natural cooling, so that a silicon-based adhesive layer having a thickness of 30 μm is formed.

In a sticking process, the fluororesin film is arranged on a flat plate so as not to make a crinkle such that the surface of the fluororesin film having the adhesive layer is directed upward. Next, after the most distal end portion of the peeling portion is chamfered and the peeling portion is degreased by using petroleum benzine, a roller closest portion (the most distal end portion of the peeling portion) in which a corner portion is chamfered is arranged at a substantially center of the fluororesin film. The film is stuck to the surface of the peeling portion from the roller closest portion as a boundary. In such a way, the peeling sheet to which the fluororesin film is stuck via the silicon-based adhesive as shown in FIGS. 5(*a*) to 5(*b*) is obtained.

Example 2

Similar to the example 1, a peeling member was manufactured by processing a distal end portion by machine processing such that a thickness of the distal end portion became 0.3 mm after processing a stainless (SUS304CSP) coil having a thickness of 1.5 mm into a predetermined size by using a progressive press die. A punching process using the press die is shown by the order of the processes (A) to (E) in FIG. 8. After the processing using the press die, a peeling sheet 10' is punched from a steel plate 20. And then, a tapered distal end portion formed by means of machine processing such that an opposite paper passing side opposite to a drawn portion is grinded into a tapered shape is cut in a longitudinal direction by means of pressing so as to enhance the precision of straightness as shown in the process (F), so that the peeling sheet 10 having a peeling portion 2 and a support portion 3 is obtained. The peeling sheet 10 has a thickness of the most distal end portion of 0.3 mm and a width of the peeling portion in the paper passing direction of 4 mm.

Next, the fluororesin film is stuck to the paper passing surface and the opposite paper passing surface of the peeling portion 2 and the paper passing surface of the support portion 3 by the method similar to that in the example 1.

Each of the peeling sheets was set together with the support member to a fixing portion of a test copying machine (fixing temperature of 190° C., copying speed of A4 size of 57 sheets/minute). Here, in the test copying machine using the peeling sheet of the example 1, the distance D1 between the most distal end portion of the peeling portion and the fixing roller is 0.4 mm, and the distance D2 between the boundary portion between the peeling portion and the support portion and the fixing roller is 1.2 mm, so that D2=3×D1 is fulfilled. Further, in the test copying machine using the peeling sheet of the example 2, the distance D1 between the most distal end portion of the peeling portion and the fixing roller is 0.2 mm, and the distance D2 between the boundary portion between the peeling portion and the support portion and the fixing roller is 1.0 mm, so that D2=5×D1 is fulfilled.

By using these test copying machines, a copying test of continuous paper feeding of 5,000 sheets of A4 plain papers on which a line chart having an image ratio of 30% was printed was performed to 30,000 sheets. The test machine was stopped at each 5,000 sheets and deterioration of an image on the printed paper was visually checked. Further, the peeling member was removed from the fixing portion, and wear of the fluororesin film, adhering of the toner, and a worn state of the fixing roller was observed.

As a result of the test, in the peeling members of the example 1 and the example 2, the deterioration of the image was not observed until the end of the paper feeding test of 30,000 sheets. The fluororesin film checked after the paper feeding test was not damaged. Further, the adhering of the toner to the peeling portion was not observed, and the wear of the fixing roller was not also observed. Further, the deformation due to jamming was not observed.

Comparative Example 1

A metal thin plate (the peeling sheet) formed of stainless steel (SUS304CSP) having a thickness of 200 μm was cut into a portion having a length of 310 mm and a width of 25 mm, and a part of a width of 5 mm and a length of 310 mm was bent perpendicularly. Next, five recess portions were formed on the bent part of the metal thin plate such that the head of the bolt is not completely protruded from the surface of the metal thin plate having the width of 20 mm, and bolt holes were formed on the bottoms of the recess portions. The thin plate and a metal support plate were stuck to each other using a silicon-based adhesive of RTV-KE1800ABC produced by Shin-Etsu Chemical Co., Ltd. and the fluororesin film was stuck similarly to the example 1, and then the same evaluation test as the example 1 was executed. As a result of the test, a whole of a connecting portion of the peeling sheet was peeled.

Comparative Example 2

A peeling sheet manufactured by the manufacturing method similar to that of the example 2 having a thickness of the distal end portion of 0.35 mm was formed, and the fluororesin film was stuck by the method similar to that of the example 1. The peeling sheet of the comparative example 2 was set together with a support member to a fixing portion of a test copying machine (fixing temperature of 190° C., copying speed of A4 size of 57 sheets/minute). In the comparative example 2, the distance D1 between the most distal end portion of the peeling portion and the fixing roller is 0.3 mm, and the distance D2 between the boundary portion between the peeling portion and the support portion and the fixing roller is 2.0 mm, so that D2>5×D1 is fulfilled.

By using the test copying machine, a copying test of continuous paper feeding of 5,000 sheets of A4 plain papers in the same condition as that in the examples 1 and 2 was performed. The plan of the copying test was performed up to 30,000 sheets, however jamming was generated after the continuous paper feeding of 2,000 sheets, and further continuous paper feeding became impossible.

INDUSTRIAL APPLICABILITY

The peeling member of the present invention capable of suppressing a waving phenomenon of a peeling sheet, contacting linearly with a roller sufficiently, preventing deformation of due to jamming of a paper and showing excellent paper peeling performance, and therefore the peeling member of the present invention can be suitably used to a peeling member for peeling a paper from various rollers such as a fixing roller installed in an electronic photographic device.

REFERENCE SIGNS LIST

1: peeling member
2: peeling portion
3: support portion

4: non-adhesive resin film
5: bolt
6: fixing roller
7: pressing roller
8: nip portion
9: paper
10: peeling sheet
11: support member
20: steel plate (metal plate)

The invention claimed is:

1. A peeling member comprising:

a peeling sheet that peels a paper from a roller of an electronic photographic device; and a support member that supports the peeling sheet to be inclined against the roller at a predetermined angle such that a distal end portion of the peeling sheet is arranged close to the roller, wherein:

the peeling sheet is formed of one metal plate, the peeling sheet including a peeling portion that forms the distal end portion, and a support portion that is thicker than the peeling portion and is fixed to the support member;

the peeling portion is arranged at one long side of the metal plate such that a paper passing surface of the peeling portion is formed as a flat surface continued to a surface of the support portion and an opposite paper passing surface of the peeling portion is formed as an inclined surface inclined against the paper passing surface such that a thickness of the peeling portion is increased from a most distal end portion of the peeling portion toward a boundary portion between the peeling portion and the support portion;

the inclined surface is arranged at a side of the roller; and a distance D1 between the most distal end portion and the roller and a distance D2 between the boundary portion and the roller fulfill a relation of $D1 \leq D2 \leq 5 \times D1$.

2. The peeling member according to claim 1, wherein the thickness of the distal end portion of the peeling portion is set in a range between 0.05 mm and 0.4 mm, and a width in a paper passing direction of the inclined surface of the peeling portion is set in a range between 1 mm and 10 mm.

3. The peeling member according to claim 1, wherein the inclined surface of the peeling portion is formed as an inclined flat surface, and an inclined angle of the inclined surface against the paper passing surface is set in a range between 5° and 45°.

4. The peeling member according to claim 1, wherein the inclined surface is formed to conform to a closest surface of the roller with respect to the inclined surface.

5. The peeling member according to claim 1, wherein:

the peeling sheet is formed by sticking a non-adhesive resin film to at least the paper passing surface of the peeling portion via a silicon-based adhesive; and the non-adhesive resin film is formed as a fluororesin film formed of at least one of polytetrafluoroethylene resin, tetrafluoroethylene-perfluoroalkyl vinyl ether copolymer resin, tetrafluoroethylene-hexafluoropropylene copolymer resin, and tetrafluoroethylene-ethylene copolymer resin.

6. A peeling device comprising:

a roller of an electronic photographic device; and a peeling member, wherein:

the peeling member comprising a peeling sheet that peels a paper from a roller of an electronic photographic device, and a support member that supports the peeling sheet to be inclined against the roller at a certain angle such that a distal end portion of the peeling sheet is arranged close to the roller;

the peeling sheet is formed of one metal plate, the peeling sheet including a peeling portion that forms the distal end portion, and a support portion that is thicker than the peeling portion and is fixed to the support member;

the peeling portion is arranged at one long side of the metal plate such that a paper passing surface of the peeling portion is formed as a flat surface continued to a surface of the support portion and an opposite paper passing surface of the peeling portion is formed as an inclined surface inclined against the paper passing surface in which a thickness is increased from a most distal end portion of the peeling portion toward a boundary portion with the support portion;

the inclined surface is arranged at a side of the roller; and a distance D1 between the most distal end portion and the roller and a distance D2 between the boundary portion and the roller fulfill a relation of $D1 \leq D2 \leq 5 \times D1$.

* * * * *